US005657725A

United States Patent [19]

Butterfield et al.

[11] Patent Number: 5,657,725

[45] Date of Patent: Aug. 19, 1997

[54] VCT SYSTEM UTILIZING ENGINE OIL PRESSURE FOR ACTUATION

[75] Inventors: Roger P. Butterfield, Trumansburg; J. Christian Haesloop, Rock Stream, both of N.Y.

[73] Assignee: Borg-Warner Automotive, Inc., Sterling Heights, Mich.

[21] Appl. No.: 715,720

[22] Filed: Sep. 19, 1996

Related U.S. Application Data

[63] Continuation of Ser. No. 306,787, Sep. 15, 1994, abandoned.

[51] Int. Cl.[6] ..... F01L 1/344

[52] U.S. Cl. ..... 123/90.17; 123/90.31

[58] Field of Search ..... 123/90.15, 90.17, 123/90.31

[56] References Cited

U.S. PATENT DOCUMENTS

| | | | |
|---|---|---|---|
| 4,771,742 | 9/1988 | Nelson et al. | 123/90.17 |
| 4,787,345 | 11/1988 | Thoma | 123/90.17 |
| 4,854,273 | 8/1989 | Uesugi et al. | 123/90.17 |
| 4,858,572 | 8/1989 | Shirai et al. | 123/90.12 |
| 4,993,370 | 2/1991 | Hashiyama et al. | 123/90.17 |
| 5,002,023 | 3/1991 | Butterfield et al. | 123/90.15 |
| 5,003,937 | 4/1991 | Matsumoto et al. | 123/90.12 |
| 5,046,460 | 9/1991 | Butterfield et al. | 123/90.15 |
| 5,107,804 | 4/1992 | Becker et al. | 123/90.17 |
| 5,172,659 | 12/1992 | Butterfield et al. | 123/90.17 |
| 5,205,249 | 4/1993 | Markley et al. | 123/90.17 |
| 5,367,992 | 11/1994 | Butterfield et al. | 123/90.17 |
| 5,386,807 | 2/1995 | Linder | 123/90.17 |

FOREIGN PATENT DOCUMENTS 388244 9/1990 European Pat. Off. .

*Primary Examiner*—Weilun Lo

*Attorney, Agent, or Firm*—Brinks, Hofer, Gilson & Lione; Greg Dziegielewski

[57] ABSTRACT

A camshaft (126) has a vane (160) secured to an end thereof for non-oscillating rotation therewith. The camshaft (126) also carries a housing (129) which can rotate with the camshaft (126) but which is oscillatable with the camshaft (126). The vane (160) has opposed lobes (**160*a*, 160*b*) which are received in opposed recesses (131, 132), respectively, of the housing (129). The recesses (131, 132) have greater circumferential extent than the lobes (160*a*, 160*b*) to permit the vane (160) and housing (129) to oscillate with respect to one another, and thereby permit the camshaft (126) to change in phase relative to a crankshaft. The camshaft (126) tends to change direction in reaction to engine oil pressure and/or camshaft torque pulses which it experiences during its normal operation, and it is permitted to either advance or retard by selectively blocking or permitting the flow of engine oil through the return lines (101, 102) from the recesses (131, 132) by controlling the position of a spool (300) within a spool valve body (198) in response to a signal indicative of an engine operating condition from an engine control unit (108). The spool (300) is selectively positioned by controlling hydraulic loads on its opposed end in response to a signal from an engine control unit (108). The vane (160) can be biased to an extreme position to provide a counteractive force to a unidirectionally acting frictional torque experienced by the camshaft (126**) during rotation.

14 Claims, 10 Drawing Sheets

VCT SYSTEM UTILIZING ENGINE OIL PRESSURE FOR ACTUATION

CROSS REFERENCE TO CO-PENDING APPLICATION

This patent application is a continuation of Ser. No. 08/306,787 filed Sep. 15, 1994, now abandoned.

FIELD OF THE INVENTION

This invention relates to a hydraulic system for controlling the operation of a variable camshaft timing (VCT) system of the type in which the position of the camshaft is circumferentially varied relative to the position of a crankshaft. In such a VCT system, a hydraulic system at least partially utilizing engine oil pressure for actuation is provided to effect the repositioning of the camshaft. A control system is provided to selectively permit or prevent the hydraulic system from effecting such repositioning.

BACKGROUND OF THE INVENTION

Consideration of information disclosed by the following U.S. Patents, which are all hereby incorporated by reference, is useful when exploring the background of the present invention.

U.S. Pat. Nos. 5,002,023 and 5,046,460 both describe a VCT system within the field of the invention in which the system hydraulics include a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft in response to torque reversals experienced within the camshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_c$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replaces the oppositely acting cylinders disclosed by the aforementioned U.S. Pat. Nos. 5,002,023 and 5,046,460. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft in response to torque reversals. The control system of this VCT system is identical to that divulged in U.S. Pat. No. 5,002,023, using the same type of spool valve responding to the same type of forces acting thereon.

Another feature of U.S. Pat. No. 5,046,460, discussed above, is biased actuation elements. A counteracting force is applied directly to the opposed cylinders to overcome the effect of a unidirectionally acting frictional torque experienced by the camshaft during normal operation. A similar problem with rotational friction also exists with any vane-type variable camshaft timing system.

In all the systems described above, timing control is achieved in response to torque reversals, or pulses, from the camshaft generated during normal operation of the engine. However, in some engines, camshaft torque reversals are not suitable for actuation of the aforementioned hydraulic system. For example, in-line six-cylinder engines have low amplitude camshaft torque characteristics which are inadequate to actuate a variable camshaft timing system. Another example is in-line four-cylinder engines which typically operate at high speeds and generate very high frequency torque pulses to which the VCT system cannot react quickly enough to cause actuation.

SUMMARY OF THE INVENTION

The current invention addresses the problems previously discussed by using the engine oil pump pressure as one source of energy for actuating the VCT mechanism. The construction of this new mechanism differs from previous mechanisms by utilizing re-routed hydraulic passages and new check valve positions. The present invention may be broken down into three separate embodiments, all of which utilize engine oil pressure, at least partially, for VCT actuation. While the embodiments are depicted primarily in use with a vane-type VCT system such as the one disclosed by U.S. Pat. No. 5,107,804, it is understood that the present invention may also be applied to systems utilizing other types of phase actuation elements such as the cylinder-type described in U.S. Pat. Nos. 5,002,023 and 5,046,460, or equivalent devices.

In the first embodiment of the present invention, a "single-chamber" system, oil pressure from the engine oil pump flows through an inlet check valve inside a spool valve and is directed into one of two opposing actuation elements. The second actuation element is vented to atmosphere by the same spool valve. If the valve is moved in a direction opposite to that of the original movement, the pressurized and vented actuation elements are reversed, causing a phase shift of the VCT mechanism.

In situations where more torque is needed to adjust the phase of the camshaft, the above embodiment can be slightly modified by adding two hydraulic lines and utilizing the "free" chambers of the recesses. The new configuration, or "double-chamber" system, will result in twice the amount of torque usually generated by the above single-chamber system. However, both the single and double-chamber systems are two-position devices only and cannot provide incremental phase adjustments to the camshaft.

The single and double-chamber devices described above, which are two-position devices only (full advance or full retard), may be modified to achieve a continuously variable system. This system allows incremental adjustments to the camshaft phase to be made in lieu of adjusting phase solely to one extreme position or its opposite. The hydraulic fluid (engine oil) inlet line is split, with a branch traveling to each recess of the vane. Check valves are provided in each branch of the inlet line to allow flow to, but not from, the recesses. When the control valve is in the null position, both recesses are fed makeup oil but neither can exhaust. This maintains the camshaft at a fixed phase angle with respect to the crankshaft. The VCT mechanism will shift toward the advanced position when the control valve is moved to allow flow to the advance recess through its inlet line and to block flow to the retard recess while opening its exhaust line to vent. The VCT mechanism will shift toward the retard position in a similar manner when the control valve is moved to allow flow to the retard recess and blocking flow to the advance recess while opening its exhaust line to vent. Precise positioning of the control valve allows this system to be continuously variable.

Another slight modification yields a configuration which counteracts the system's "natural" tendency to retard due to frictional torque experienced by the camshaft. The advance chamber is connected to supply oil pressure instead of venting to atmosphere. This gives the system a bias in the advance direction opposite to the natural bias in the retard direction so that the system will advance utilizing supply pressure alone, but will only retard with some torque pulse characteristics in that direction.

The second embodiment of the present invention utilizes both engine oil pressure and camshaft torque pulses in combination as the source of energy for actuation. The oil exit of the advance recess has a split path, with one path going through a check valve to the retard recess, and the other path going directly to exhaust. If there is a significant torque pulse pressurizing the advance recess, the check valve will open when the advance recess pressure exceeds supply pressure. Oil will then flow through two paths: one path feeds the retard recess through the check valve while the other feeds to exhaust. If the pressure generated in the advance recess by a torque pulse is less than the makeup pressure from the engine, then the check valve will remain closed and the only exit path from the advance recess will be through the exhaust. Therefore, oil will flow to the retard recess due to oil from the advance recess or from makeup oil through the inlet check valve. With the control valve in the other extreme position, oil will empty from the retard recess and the advance recess will fill with oil. This design has the advantage of requiring less makeup oil flow than in other mechanisms while still being able to operate under any condition, such as high speed, since oil pump pressure is also used as a source of actuation.

The third embodiment of the present invention is a dual-mode hybrid device with a three-position spool valve utilizing a slightly modified hydraulic line configuration. The system will either operate in the "oil pressure only" mode and/or the "torque pulse only" mode, depending upon the position of the spool valve. The selection of one of the valve's three positions is governed by the engine control unit which is typically pre-programmed to respond to various conditions and engine parameters. The three-position spool valve device can only achieve full advance or full retard and cannot maintain an intermediate position.

An additional feature of the present invention involves biasing the actuation elements in a manner very similar to that disclosed in U.S. Pat. No. 5,046,460. The biasing provides a force counteractive to a unidirectional frictional torque experienced by the camshaft during the rotation of normal operation. Biasing the actuation elements can be achieved either by modifying the hydraulic line configuration to allow the use of engine oil pressure as a biasing force on the actuation element or by employing a mechanical spring to act directly upon the actuation element.

Accordingly, it is an object of the present invention to provide an improved method and apparatus for varying camshaft timing in an internal combustion engine.

It is a further object of the present invention to provide an improved method and apparatus for varying camshaft timing in an automotive variable camshaft timing system which utilizes oppositely acting hydraulic means at least partially actuated by engine oil pressure.

For a further understanding of the present invention and the objects thereof, attention is directed to the drawings and the following brief descriptions thereof, to the detailed description of the preferred embodiment, and to the appended claims.

DETAILED DESCRIPTION OF THE PREFERRED EMBODIMENT

The present invention relates to an internal combustion engine having a conventional crankshaft and camshaft arrangement as shown in FIGS. 1A–4B. Crankshaft 426 is connected to camshaft 126 via chain 403 which engages crankshaft sprocket 402 and camshaft sprocket 401.

Figure 1A:
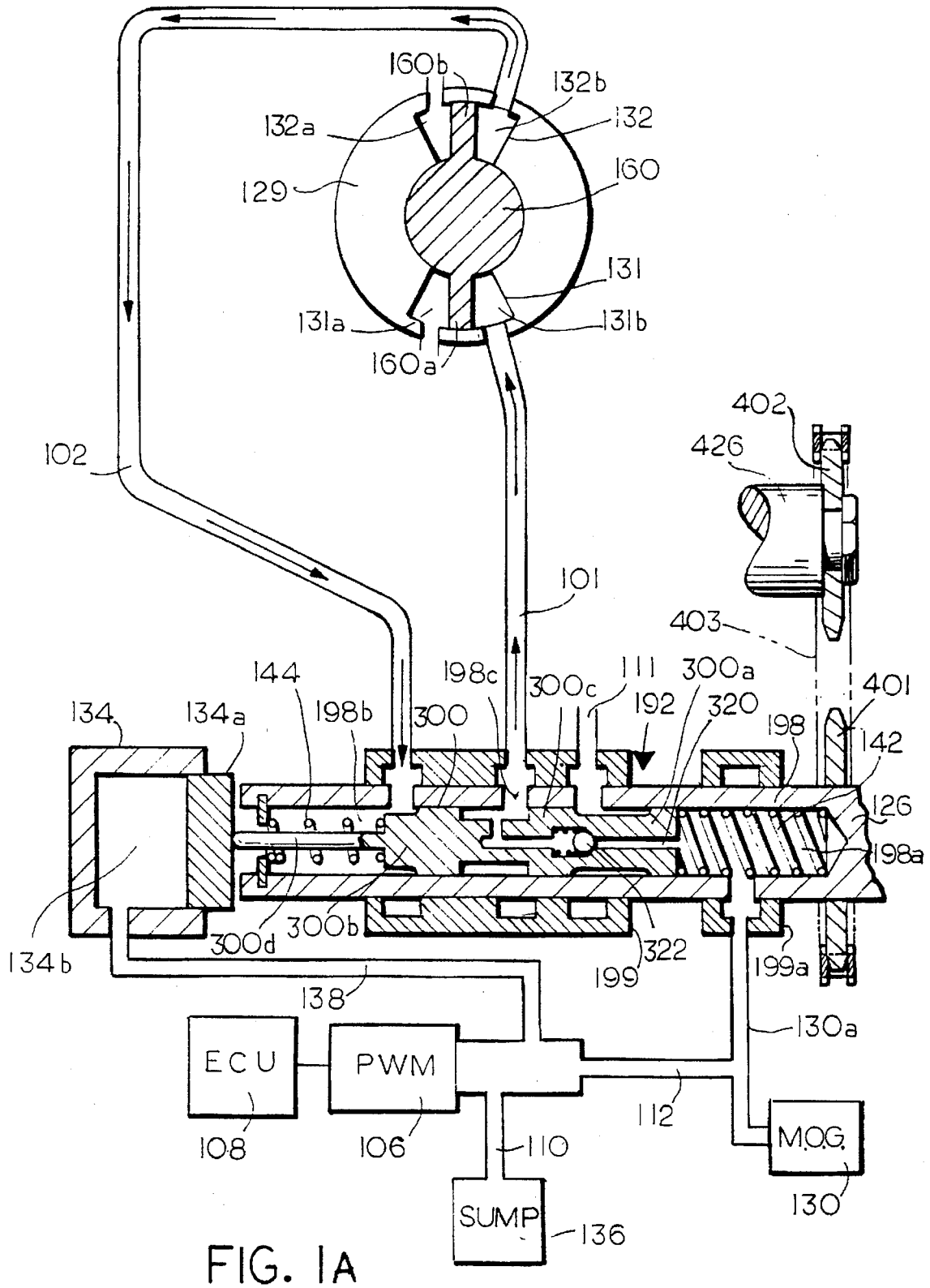
FIG. 1A is a schematic view of the hydraulic equipment of a single-chamber two-position vane-type VCT arrangement according to an embodiment of the present invention in which only engine oil pressure provides the energy for phase shift actuation illustrating the condition where the control valve is in the advance position.

The most basic embodiment of the present invention, referred to as a "single-chamber" system, is shown schematically in FIG. 1A. Lobes 160*a* and 160*b* of annular pumping vane 160 function as hydraulic operators to ultimately effect the phase adjustment of camshaft 126 with respect to the crankshaft in response to engine oil pressure only. Vane 160 and associated hardware may be of standard construction, such as that described by the U.S. Patents previously incorporated by reference.

Hydraulic fluid, in the form of engine oil, flows into either recess 131 or 132 of housing 129 via hydraulic line 101 or 102, respectively, depending upon the direction of the phase adjustment required. Each recess is divided into two chambers, each chamber being separated by a vane lobe: recess 131 is divided into chambers 131*a* and 131*b*, being separated by lobe 160*a*, best shown in FIG. 1A; recess 132 is divided into chambers 132*a* and 132*b*, being separated by lobe 160*b*. Engine oil enters either line 101 or 102 by way of spool valve assembly 192 which is incorporated into camshaft 126.

Spool valve assembly 192 is made up of cylindrical member 198 and spool 300 which is slidable to and fro within member 198. Member 198 also contains atmospheric vents 111 and 198*b* to facilitate the flow of engine oil. Spool 300 has cylindrical lands 300*a* and 300*b* on opposed ends thereof and center land 300*c* which is also cylindrical, all of which fit snugly within member 198 and are capable of selectively blocking the flow of engine oil to and from recesses 131 and 132. Spool 300 also contains small, internal passage 320. Check valve 322 is located in internal passage 320 to block the flow of oil to cavity 198*a* of cylindrical member 198 from recesses 131 or 132.

The position of spool 300 within member 198 is influenced by two distinct sets of opposing forces. First, spring 142 acts on the end of land 300*a* and resiliently urges spool 300 to the left, in the orientation illustrated in FIG. 1A. Second spring 144 acts on land 300*b* and resiliently urges spool 300 to the right. Second, oil pressure from cavity 198*a* also acts upon land 300*a*, urging spool 300 to the left and opposes the force applied to spool extension 300*d* by hydraulic piston 134*a*, also due to engine oil pressure.

The pressure within hydraulic cylinder 134 is controlled by a pressure control signal from controller 106, preferably of the pulse width modulated type (PWM), in response to a control signal from electronic engine control unit (ECU) 108, shown schematically, which may be of conventional construction. Controller 106 receives engine oil from main oil gallery 130 of the engine through inlet line 112 and regulates oil pressure in hydraulic line 138 and hydraulic cylinder cavity 134 by exhausting excess engine oil to sump 136 via hydraulic line 110.

Since the single chamber vane-type VCT is a two position device, i.e., full advance or full retard, an intermediate position is not achievable.

As control oil pressure in cylinder 134 is increased, spool 300 is urged to the far right, i.e., the full advance position, by pressurized piston 134*a*, as oriented in FIG. 1A, allowing oil to flow from main oil gallery 130 into cavity 198*a*, through internal passage 320, through hydraulic line 101, and into chamber 131*b* of recess 131, and also creating a flow path to vent cavity 198*b*. Vane 160 is rotated in the clockwise direction due to the oil pressure on lobe 160*a*, causing lobe 160*b* to force oil out of chamber 132*b* and exhausting the oil through hydraulic line 102 to vent cavity 198*b*.

When there is a decrease in control oil pressure in hydraulic cylinder 134, the force of spring 142 overcomes the relatively low oil pressure applied to piston 134*a* to spool 300 and urges spool 300 to the far left, that is, the full retard position (not shown). With spool 300 in the retard position, engine oil flows from main oil gallery 130 into cavity 198*a* through internal passage 320 through hydraulic line 192 and into chamber 132*b* of recess 132. The pressure of the engine oil on lobe 160*b* rotates vane 160 in the counterclockwise direction, causing lobe 160*a* to force oil out of chamber 131*b* and exhausting oil through hydraulic line 101 and vent 111.

Figure 1B:
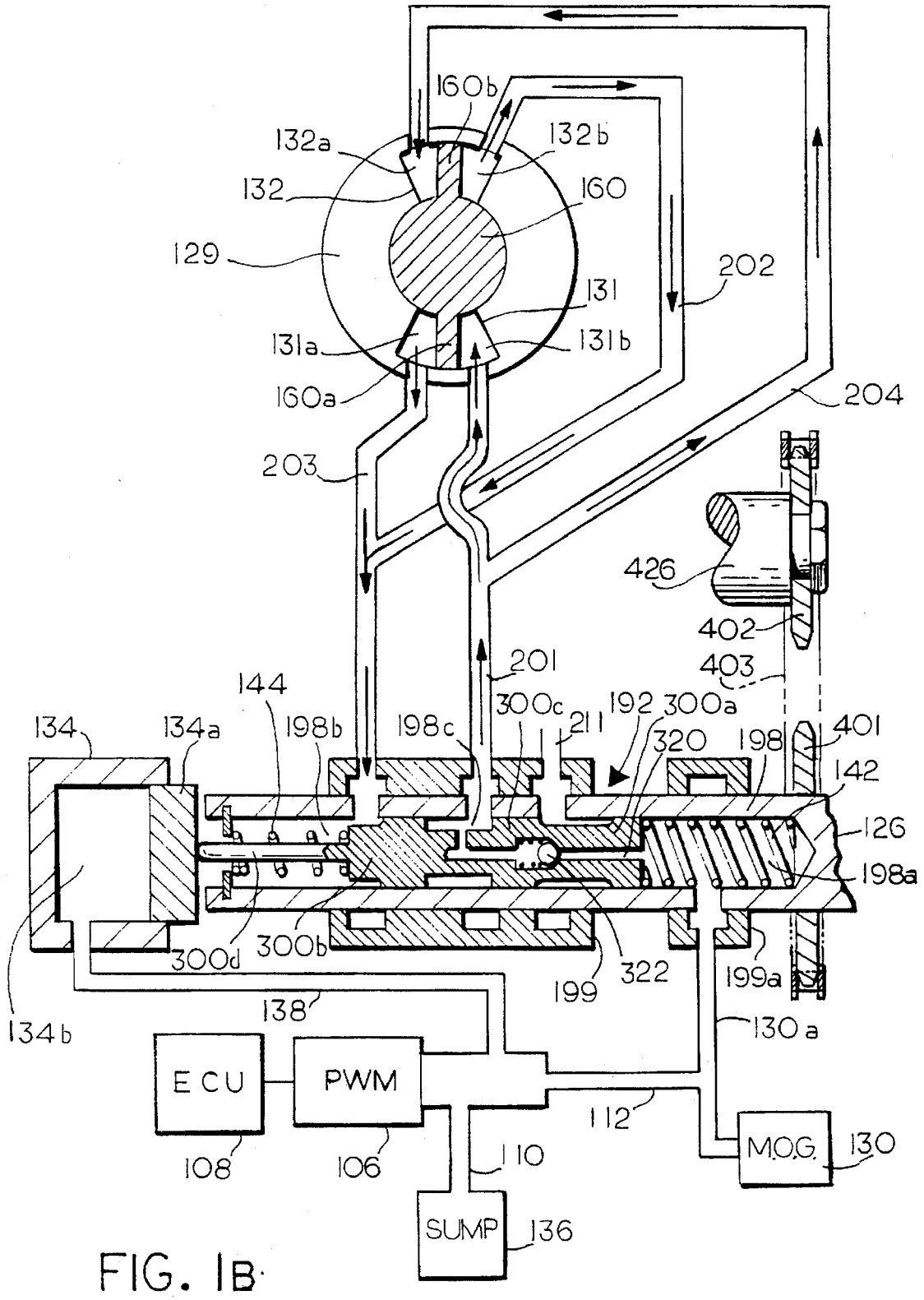
FIG. 1B is a schematic view of the hydraulic equipment of a double-chamber two-position vane-type VCT arrangement according to an embodiment of the present invention in which only engine oil pressure provides the energy for phase shift actuation illustrating the condition where the control valve is in the advance position.

When design requirements so dictate, the single chamber system may be modified to produce twice as much torque to effectuate the camshaft phase adjustment. This "double-chamber" system, as shown in FIG. 1B, is also a two-position system only and therefore is unable to maintain an intermediate position.

Like the single-chamber system, the double-chamber system has one hydraulic line 201 connecting spool valve assembly 192 and recess 131*b* and one hydraulic line 202 connecting spool valve assembly 192 and recess 132*b*. In addition, a third hydraulic line 203 connects line 202 with recess 131*a*, and a fourth line 204 connects line 201 and recess 132*a*.

In the full advance position, oil flows from the main oil gallery 130 through cavity 198*a*, through internal passage 320, through line 201 to recess 131*b* and through line 204 to recess 132*a*. The oil puts pressure on both lobes 160*a* and 160*b* to cause vane 160 to rotate in the clockwise direction. Lobe 160*a* forces oil out of recess 131*a* into line 203 and lobe 160*b* forces oil out of recess 132*b* into line 202 to be exhausted to cavity 198*b* to vent.

For the retard position, the oil flow paths are opposite that of the advance position. Spool 300 is urged to the left by spring 142 which allows oil to flow through line 203 to recess 131*a* and through line 202 to recess 132*b*. The pressure on lobes 160*a* and 160*b* cause vane 160 to rotate in the counterclockwise direction, causing oil to flow from recesses 131*b* and 132*a* through lines 201 and 204, respectively, to be exhausted through vent 211.

Because oil pressure is applied to both lobes 160*a* and 160*b* of vane 160 instead of only one lobe, as in the single-chamber system, twice the amount of torque is applied to vane 160 as in the single-chamber system. The control portion of the system works identically to that of the single-chamber system.

Figure 1C:
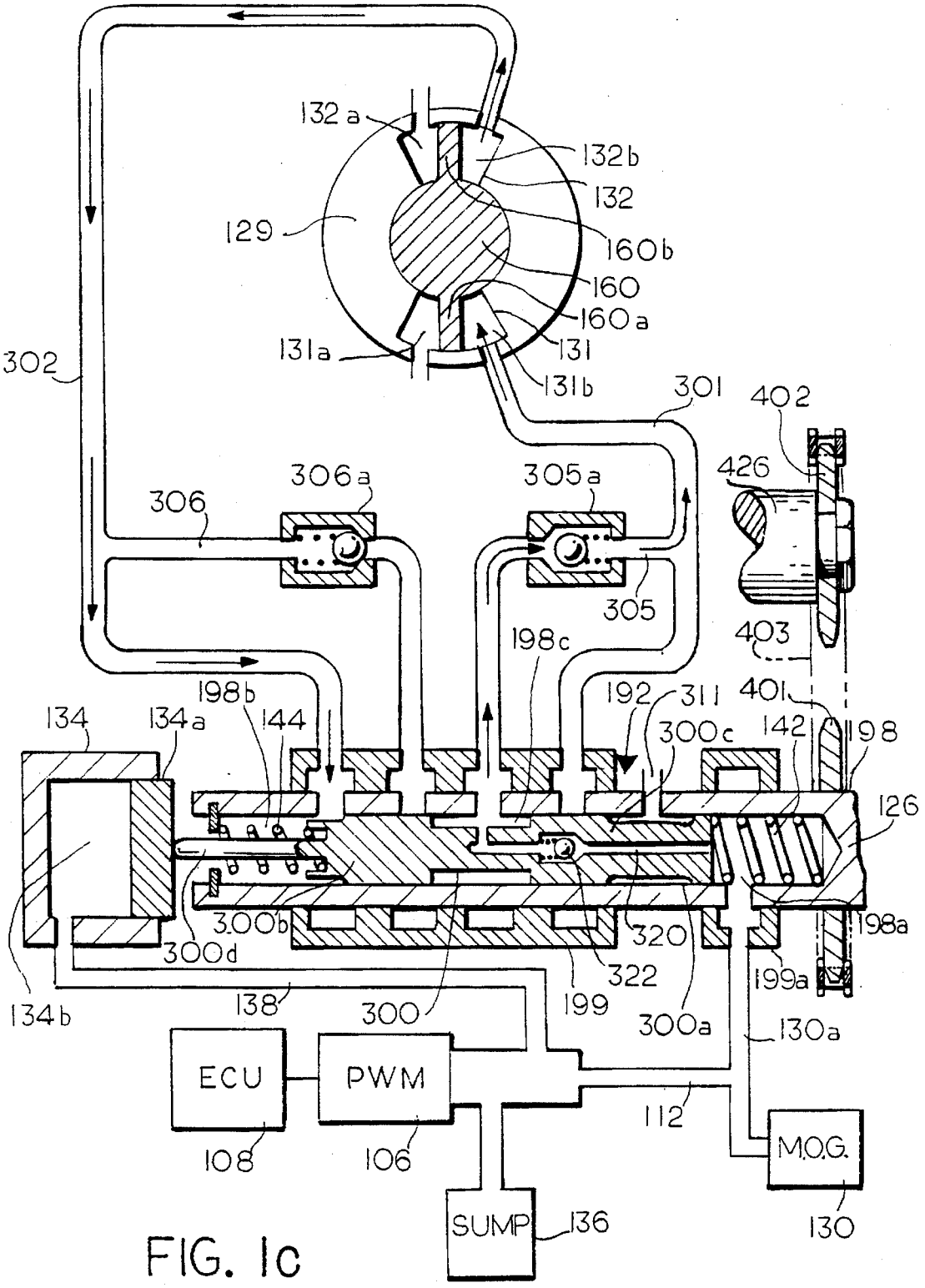
FIG. 1C is a schematic view of the hydraulic equipment of a continuously variable vane-type VCT arrangement according to an embodiment of the present invention in which only engine oil pressure provides the energy for phase shift actuation illustrating the condition where the control valve is in the advance position.

The disadvantage of the above two systems, of course, is that they only allow for extreme changes in the angular position of the camshaft with respect to the crankshaft. FIG. 1C illustrates an improved continuously variable VCT system which allows for incremental changes in vane movement, resulting in proportional changes in camshaft phase angle.

In a single-chamber continuously variable system, hydraulic line 301 connects spool valve assembly 192 with recess 131*b* and line 302 connects spool valve assembly 192 with recess 132*b*. Line 305 connects spool valve assembly 192 with line 301, with check valve 305*a* located therebetween. Line 306 connects spool valve assembly 192 with line 302, with check valve 306*a* located therebetween.

In the null position (not shown), land 300*c* blocks oil flow through line 301 and land 300*b* blocks oil flow through line 302, while lines 305 and 306 remain open, allowing make-up oil to flow to recesses 131*b* and 132*b*, respectively. With make-up oil feeding both recesses 131*b* and 132*b*, but with all exhaust paths blocked, vane 160 is not allowed to move and camshaft phase remains constant.

As control oil pressure increases, hydraulic piston 134*a* begins to urge spool 300 to the right, and oil begins to flow from the main oil gallery 130 through cavity 198*a*, through internal passage 320, through line 305, through check valve 305*a*, to line 301, and finally to recess 131*b*. Vane 160 begins to rotate in the clockwise direction due to the oil pressure exerted on lobe 160*a*, and lobe 160*b* begins to force oil out of recess 132*b* through line 302, made possible because the movement of spool 300 has also partially opened an exhaust path to cavity 198*b*. The backflow of oil through line 306 is prevented by check valve 306*a*. If control oil pressure continues to increase, spool 300 is further urged to the right, up to and including the full advance position, as depicted by FIG. 1C. With spool 300 responding directly to control oil pressure, and backflow of oil through line 306 prevented, spool 300 may return to the null position as soon as the phase angle of the camshaft is optimized, thus stabilizing the vane in an intermediate position.

The operation of the continuously variable system in the retard position (not shown) utilizes the exact opposite engine oil flow paths as that of the advance position. As control oil pressure decreases, spring 142 exerts a force upon spool 300 which exceeds the forces of hydraulic cylinder 134 and spring 144 on the opposite side of spool 300, thereby causing spool 300 to move to the left. Oil flows from main oil gallery 130 through line 130*a* through cavity 198*a*, through internal passage 320, through line 306 and check valve 306*a*, and into recess 132*b*. The force of oil pressure on lobe 160*b* causes vane 160 to rotate in the counterclockwise direction, thus forcing oil out of recess 131*b*. Oil is exhausted back to atmosphere through line 301, spool 300, and vent 311, with the backflow through line 305 being blocked by check valve 305*a*. Thus, an incremental change in phase of camshaft 126 in the retard direction is achieved.

Another slight modification can be used for specific engine characteristics, for example, an engine that has high retard tendencies and low advance tendencies. The new configuration is designed such that the system can advance utilizing supply pressure alone, but can only retard if torque pulse characteristics in that direction exist.

Figure 1D:
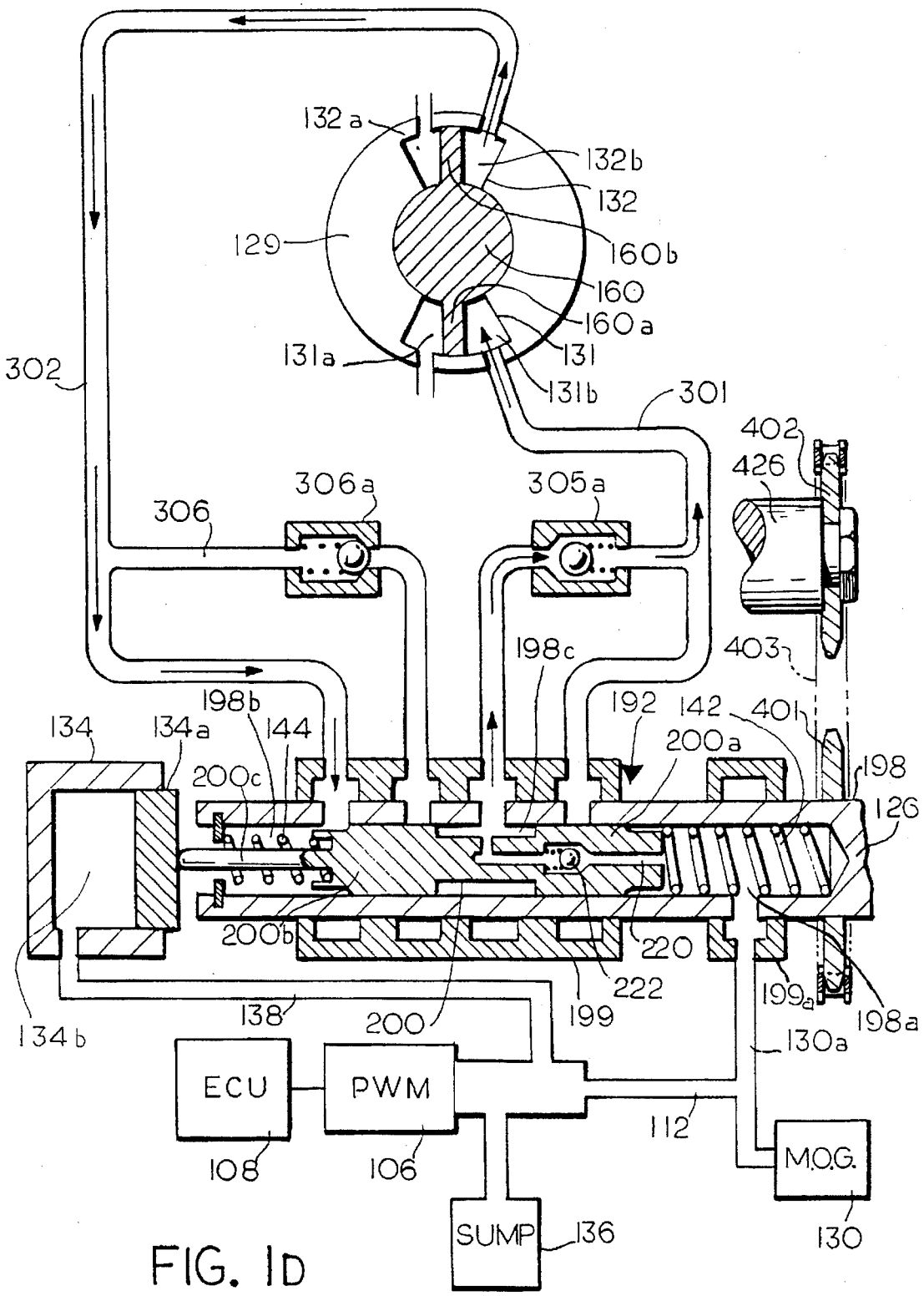
FIG. 1D is a schematic view of the hydraulic equipment of a continuously variable vane-type VCT arrangement according to an embodiment of the present invention in which at least slight torque pulse characteristics must be present to provide the energy for phase shift actuation illustrating the condition where the control valve is in the advance position.

The modified system, shown in FIG. 1D, is similar to the above-described continuously variable system except that the vent to atmosphere 311 (shown in FIG. 1C) is eliminated, a two-land spool 200 is used, and the advance chamber 131*b* is connected to supply oil pressure via hydraulic line 301.

In the null position (not shown) the modified system works identically to the above-described continuously variable system. Land 200*a* blocks oil flow through line 301 and land 200*b* blocks oil flow through line 302, while lines 305 and 306 remain open, allowing make-up oil to flow to recesses 131*b* and 132*b*, respectively. With make-up oil feeding both recesses 131*b* and 132*b*, but with all exhaust paths blocked, vane 160 is not allowed to move and camshaft phase remains constant.

The advance position, shown in FIG. 1D, is also identical to the above-described continuously variable system. As control oil pressure increases, hydraulic piston 134*a* begins to urge spool 200 to the right, and oil begins to flow from the main oil gallery 130 through cavity 198*a*, through internal passage 220, through line 305, through check valve 305*a*, to line 301, and finally to recess 131*b*. Vane 160 begins to rotate in the clockwise direction due to the oil pressure exerted on lobe 160*a*, and lobe 160*b* begins to force oil out of recess 132*b* through line 302, made possible because the movement of spool 200 has also partially opened an exhaust path to cavity 198*b*. The backflow of oil through line 306 is prevented by check valve 306*a*. If control oil pressure continues to increase, spool 200 is further urged to the right, up to and including the full advance position, as depicted by FIG. 1D. With spool 200 responding directly to control oil pressure, and backflow of oil through line 306 prevented, spool 200 may return to the null position as soon as the phase angle of the camshaft is optimized, thus stabilizing the vane in an intermediate position.

It is in the retard position (not shown) where the difference in operation between the embodiments illustrated by FIG. 1C and FIG. 1D occurs (the engine must display some torque pulse characteristics in FIG. 1D for the system to retard). As control oil pressure decreases, spring 142 exerts a force upon spool 200 which exceeds the forces of hydraulic piston 134*a* and spring 144 on the opposite side of spool 200, thereby causing spool 200 to move to the left. Oil flows from main oil gallery through line 130*a* through cavity 198*a*, through internal passage 220, through line 306, check valve 306*a*, line 302, and into recess 132*b*. Oil also flows from cavity 198*a*, through spool 200, line 301 and into recess 131*b*. The force of oil pressure on lobes 160*a* and 160*b* is now equal and vane 160 is not allowed to move due to the action of supply pressure alone. A torque pulse is required to pressurize recess 131*b* to a higher pressure found in cavity 198*a*. When such a torque pulse occurs, vane 160 is urged to rotate in the counterclockwise direction which causes lobe 160*a* to increase pressure within recess 131*b*, thus overcoming supply oil pressure and forcing oil out of recess 131*b*. The backflow of hydraulic fluid is still blocked by check valve 305*a* as before, but oil is not exhausted back to atmosphere, as shown in FIG. 1C (through line 301, spool 300, and vent 311). Oil out of recess 131*b* backflows through line 301 and spool 200 to cavity 198*a*. Since the backflow of oil is resisted by supply oil pressure, the high retard tendency of the engine is reduced. This embodiment is a method for equalizing the retard and advance actuation rates.

Figure 2:
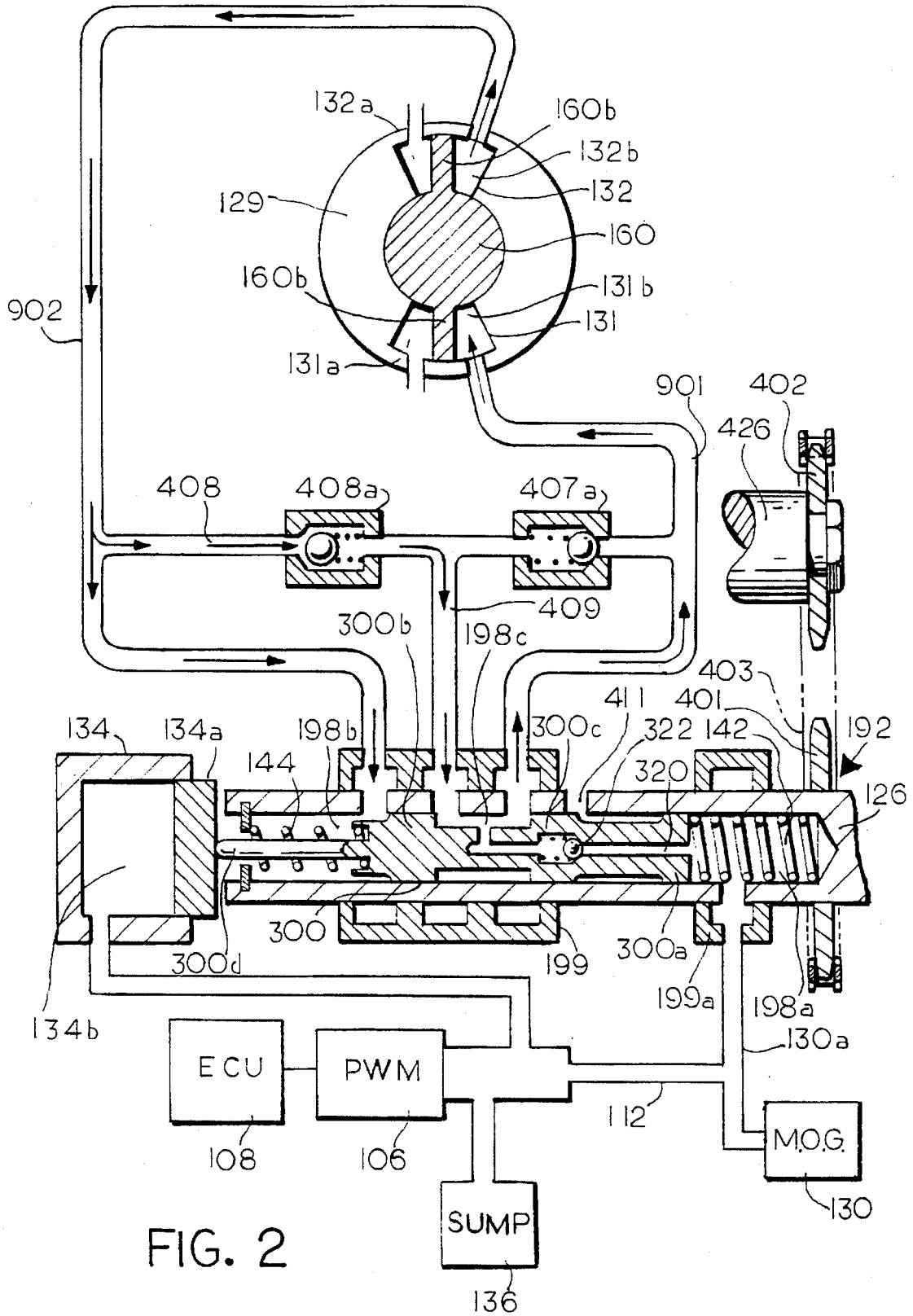
FIG. 2 is a schematic view of the hydraulic equipment of a hybrid vane-type VCT arrangement according to an embodiment of the present invention in which both torque reversals and engine oil pressure provide the energy for phase shift actuation illustrating the condition where the control valve is in the advance position.

If an engine displays some torque pulse characteristics, but the pulses alone are not always adequate to actuate the VCT system, it is possible to construct a system that uses either torque pulses or engine oil pressure for actuation. FIG. 2 schematically illustrates an embodiment of such a system. Hydraulic line 409 terminates at a juncture between opposed check valves 407*a* and 408*a* which are connected to recesses 131*b* and 132*b*, respectively, by branch lines 401 and 402, respectively. The remainder of the associated hardware, including vane 160 and spool valve assembly 192 may be constructed as previously described.

For the system to retard (not shown), the otl exit of recess 131*b* has a split path, with one branch connecting to recess 132*b* and the other connecting to exhaust. If a significant torque pulse pressurizes recess 131*b*, then engine oil will flow to recess 132*b* via check valve 407*a*, line 409, cavity 198*c*, and line 402. If the pressure generated by the torque pulse is less than supply pressure, check valve 407*a* will remain closed and the only exit path from recess 131*b* will be to exhaust via line 401 and vent 411. Recess 132*b* then will be filled by make-up oil flowing from main oil gallery 130 through line 130*a*, cavity 198*a*, internal passage 320, and line 402.

For the system to advance, as shown in FIG. 2, the flow path is opposite that of the retard position. If a significant torque pulse pressurizes recess 132*b*, then engine oil will flow to recess 131*b* via check valve 408*a*, line 409, cavity 198*c*, and line 401. If the pressure generated by the torque pulse is less than supply pressure, check valve 408*a* will remain closed and the only exit path from recess 132*b* will be to exhaust via line 402 and cavity 198*b*. Recess 131*b* will then be filled by make-up oil flowing from main oil gallery 130 through line 130*a*, cavity 198*a*, internal passage 320, and line 401. The system shown in FIG. 2 has the advantage of requiring less make-up oil flow than previously described systems while still being able to operate under any condition, such as high speed, because of the use of oil pump pressure. However, the system is two-position only and is not capable of maintaining intermediate phase adjustments.

Figure 3A:
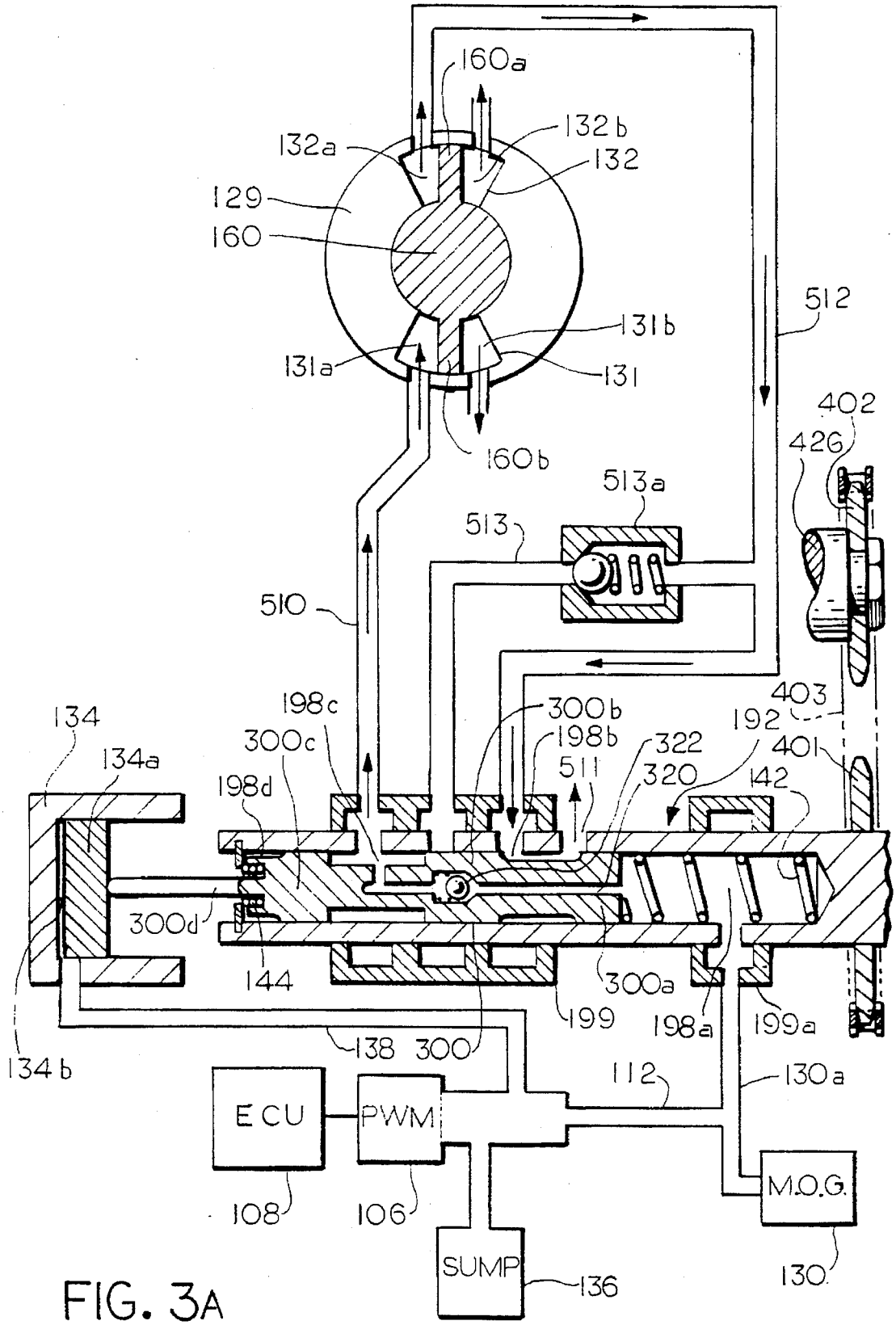
FIG. 3A is a schematic view of the hydraulic equipment of a vane-type VCT arrangement having a three-position valve according to an embodiment of the present invention where the valve is in the first position.
Figure 3B:
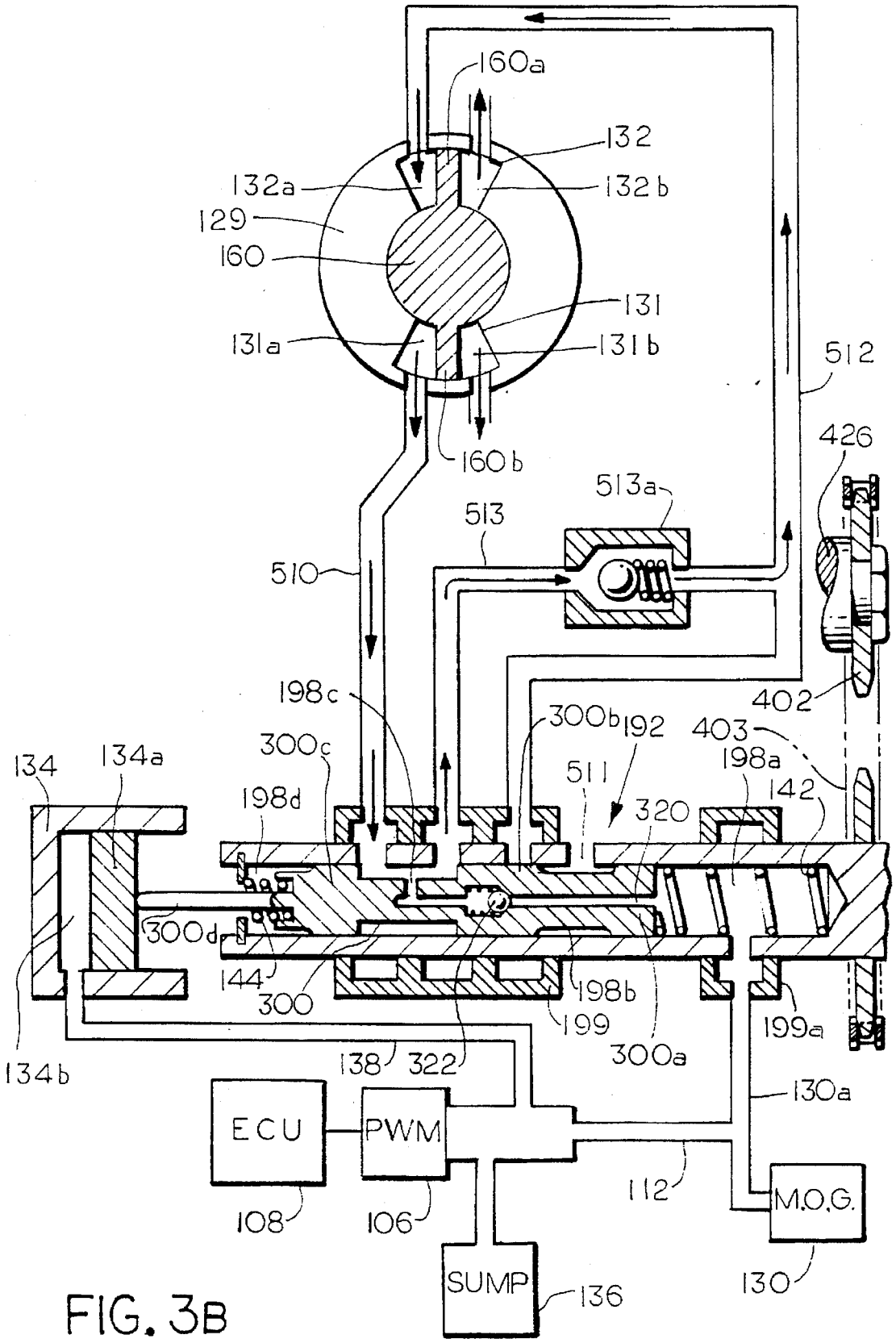
FIG. 3B is a schematic view of the hydraulic equipment of a VCT arrangement having a three-position valve according to an embodiment of the present invention where the valve is in the second position.
Figure 3C:
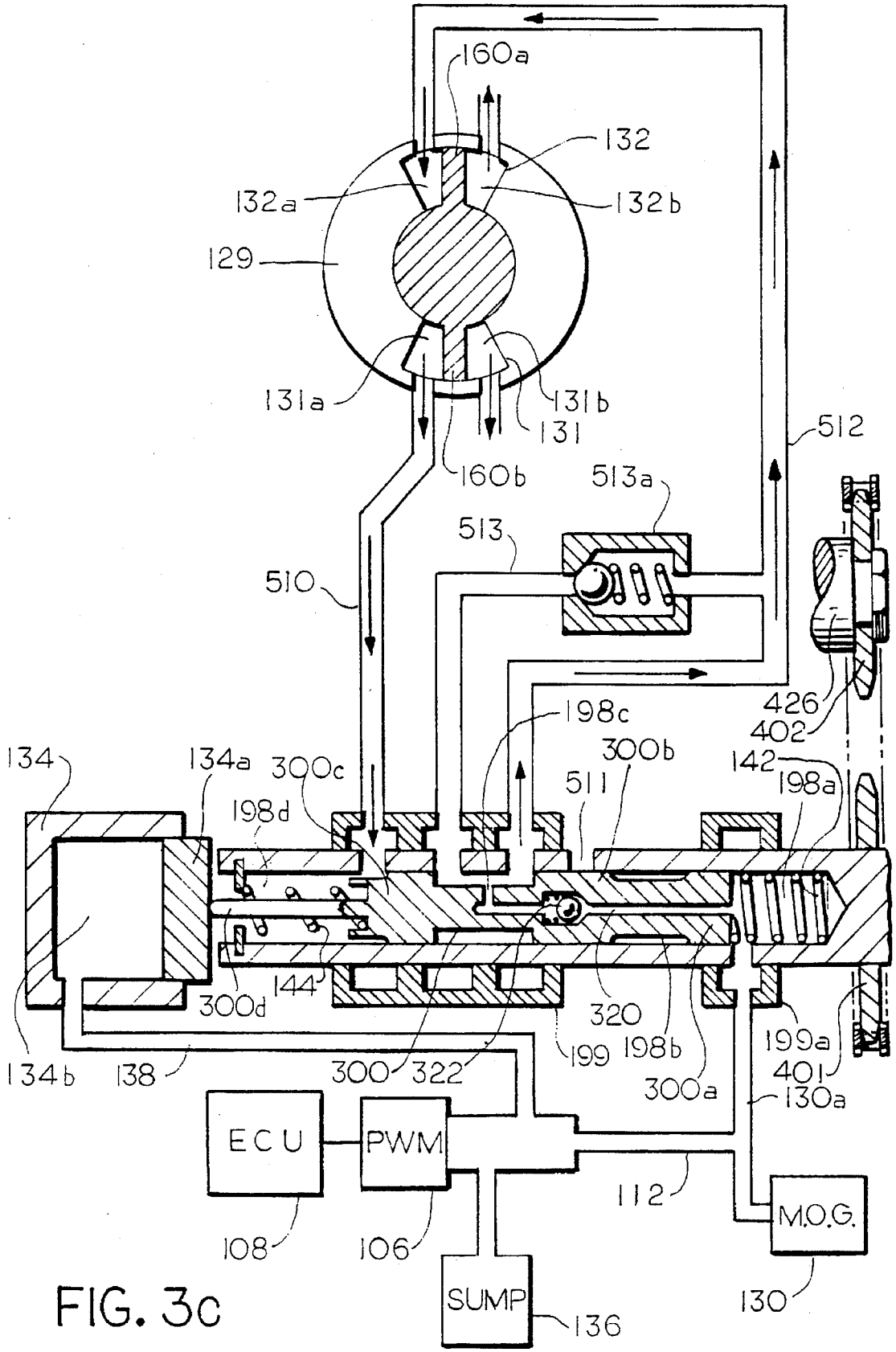
FIG. 3C is a schematic view of the hydraulic equipment of a VCT arrangement having a three-position valve according to an embodiment of the present invention where the valve is in the third position.

FIGS. 3A–3C illustrate an alternate embodiment of the present invention utilizing a three-position spool valve. The position of spool 300 is controlled by engine control unit 108 which is pre-programmed to recognize various engine conditions and direct the movement of spool 300 accordingly.

Hydraulic lines 510 and 512 connect spool valve assembly 192 with chambers 131*a* and 132*a*, respectively, while chambers 131*b* and 132*b* are vented to atmosphere. Hydraulic line 513 connects spool valve assembly 192 with line 512, and check valve 513*a* is located therebetween. Spool 300 is a standard three-land spool, as previously described, and vane 160 and associated hardware are of standard construction.

For the system to retard, spool 300 is located in its first position, to the left, as illustrated in FIG. 3A. With cavity 198*c* aligned with hydraulic line 510, a flow path is thereby created. Engine oil located in main oil gallery 130 flows through line 130*a*, through cavity 198*a*, through internal passage 320, and through line 510 to chamber 131*a*. The pressure on lobe 160*b* causes vane 160 to rotate in the counterclockwise direction, thus causing lobe. 160*a* to force oil out of chamber 132*a*. The exhausted oil flows through line 512 to cavity 198*b* in spool valve assembly 192 and then out through vent 511. Additionally, actuation is assisted by positive torque, i.e., torque which urges vane 160 to rotate in the counterclockwise direction, pressurizing recess 132*a*, thus causing oil in recess 132*a* to exhaust more rapidly. Backflow of oil through line 513 is prevented by check valve 513*a* and also by land 300*b* which blocks line 513. Thus system actuation to the full retard position is achieved by utilizing oil pressure assisted by positive torque pulses.

In an alternate scenario where engine conditions are such that negative torque pulses are sufficient to actuate the timing system to the full advance position, spool 300 is relocated to its second position, as shown in FIG. 3B, and a different flow path is created. If a significant negative torque pulse pressurizes recess 131*a*, engine oil will flow to recess 132*a* via line 510, cavity 198*c*, line 513, check valve 513*a*, and line 512 to chamber 132*a*. Pressure on lobe 160*a* forces vane 160 to rotate in the clockwise direction, advancing the camshaft. Check valve 513*a* prevents any backflow from recess 132*a* when positive torque pulses pressurize recess 132*a*. Furthermore, backflow of oil into internal passage 320 is prevented by internal check valve 322. Thus, system actuation to the full advance position is achieved by utilizing negative torque pulses only.

When no torque pulses, either positive or negative, are present when the spool 300 is in the second position, check valve 513*a* opens and both the advance recess 132*a* and the retard recess 131*a* are fed make-up oil. Since the pressure in both recesses is equalized, no actuation occurs.

Finally, when oil pressure is high but torque pulses are insufficient to actuate the system, spool 300 is directed to its third position, as shown in FIG. 3C. Engine oil then flows from main oil gallery 130, through line 130*a*, through cavity 198*a*, through internal passage 320, through line 512, into chamber 132*a*. Pressure on lobe 160*a* forces vane 160 to rotate in the clockwise direction, causing lobe 160*b* to force oil out of chamber 131*a*. Exhausted oil flows through line 510 and into cavity 198*d*. Backflow of oil into internal passage 320 is prevented by internal check valve 322. Thus, system actuation is achieved by utilizing oil pressure only when oil pressure is high.

Another feature of the present invention is a biased actuation element. During operation, a rotating camshaft experiences a frictional force which opposes movement in the direction of rotation. The frictional force is introduced by such items as camshaft journal bearings and cam lobe followers found in a conventional engine, thus causing the timing system to retard. To counteract this frictional force, an equal and opposite force may be applied directly to the actuation element, in this case, vane 160.

Figure 4A:
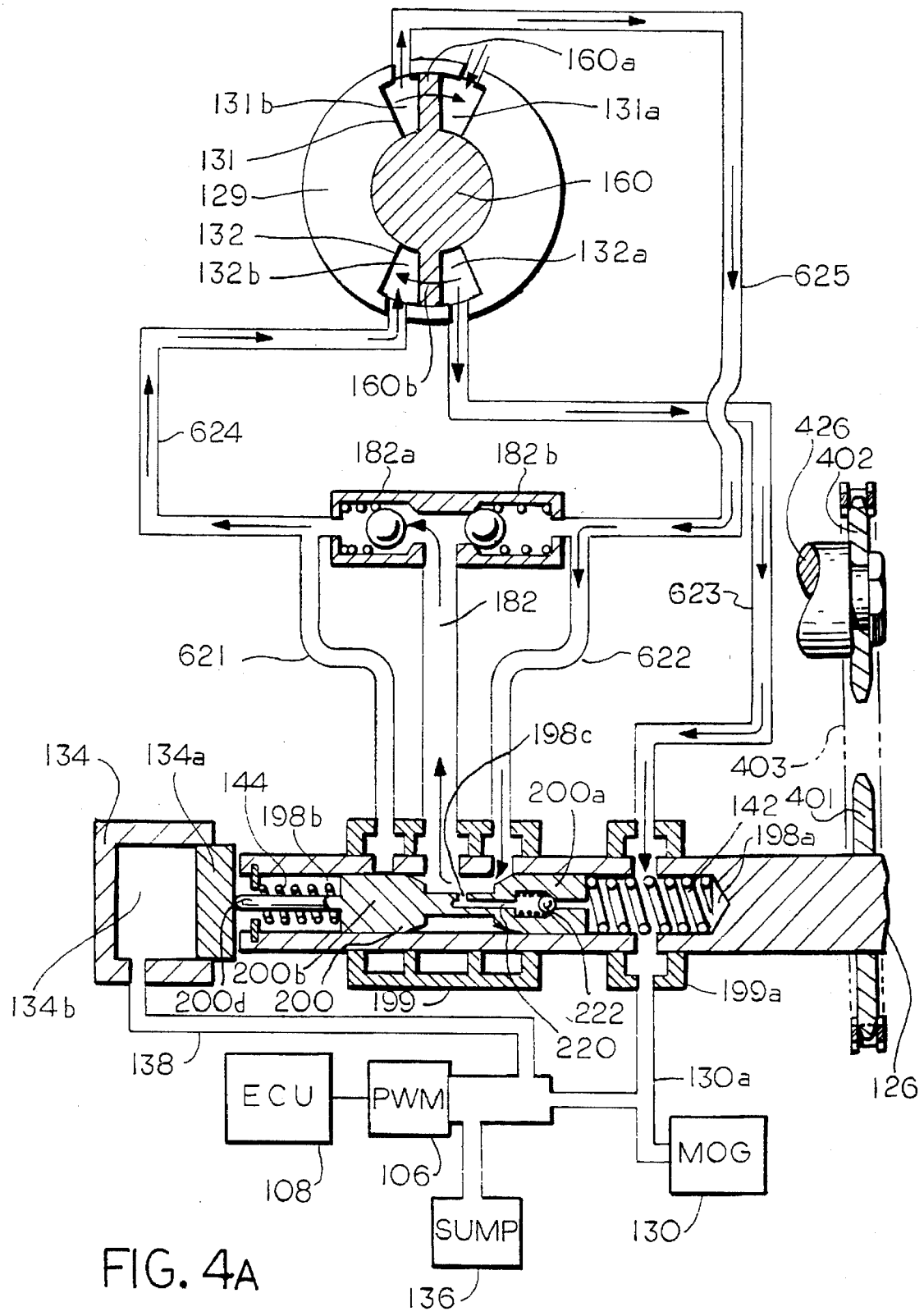
FIG. 4A is a schematic view of the hydraulic equipment of a standard vane-type VCT arrangement according to an embodiment of the present invention utilizing engine oil pressure as a biasing force in the advance direction on the hydraulic actuator; and, FIG. 4B is a schematic view of the hydraulic equipment of a standard vane-type VCT arrangement according to an embodiment of the present invention utilizing engine oil pressure as a biasing force in the advance direction on the hydraulic actuator.
Figure 4B:
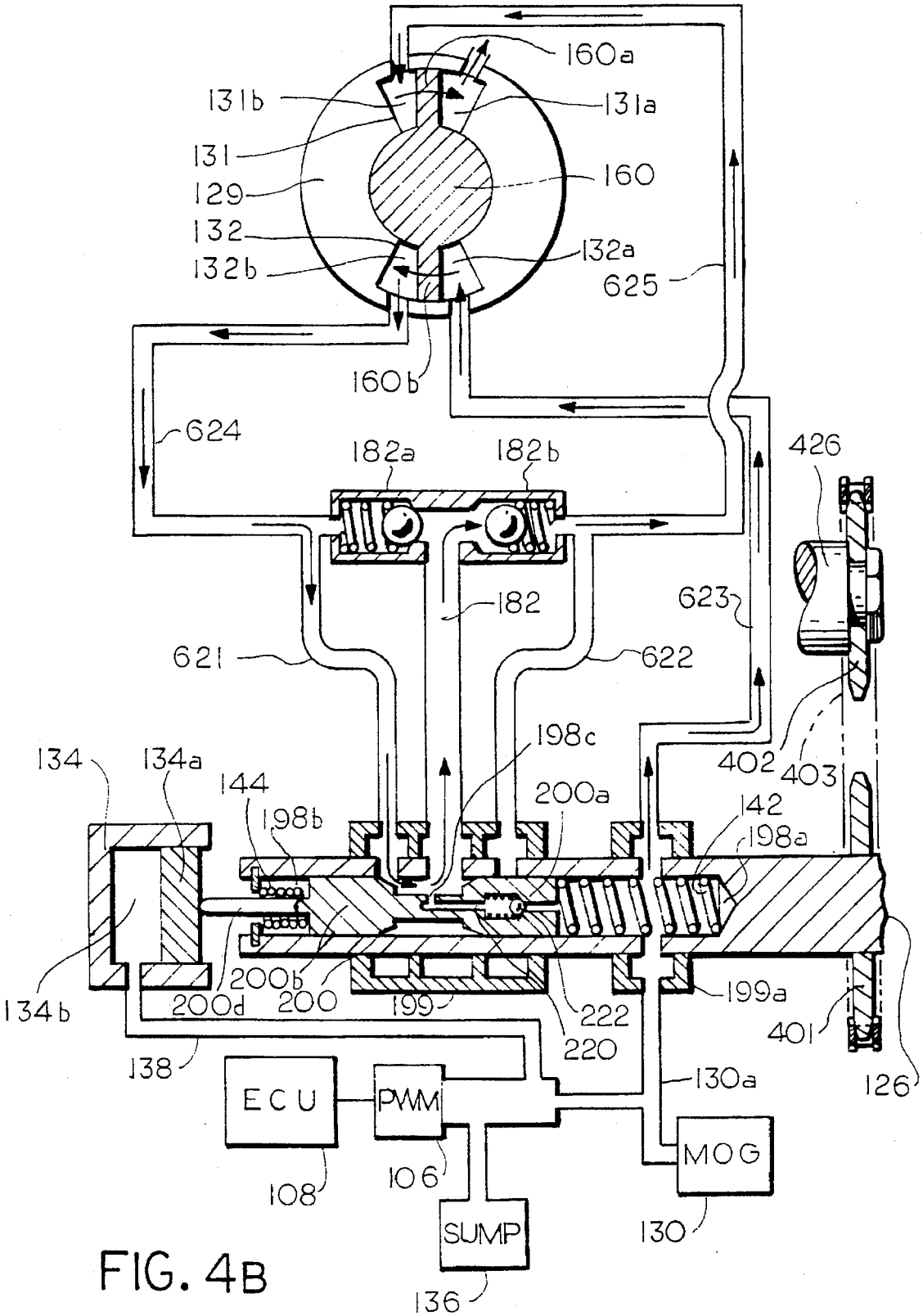

One method of applying such a force is to modify the hydraulic line configuration so that engine oil can be utilized as a biasing force, as shown in FIGS. 4A & 4B. This embodiment is a two-position device only, that is, full advance or full retard, and cannot maintain an intermediate position.

Recess 132*a*, designated the oil pressure bias recess, is connected to spool valve assembly 192 via hydraulic line 623. Recess 132*b* is connected to spool valve assembly 192 via line 621 and line 624, which is connected to spool valve assembly 192 via input line 182, with check valve 182*a* located therebetween. Recess 131*b* is connected to spool valve assembly 192 via line 622 and line 625, which is connected to spool valve assembly 192 via input line 182, with check valve 182*b* located therebetween. Recess 131*a* exhausts to atmosphere.

Shown in FIG. 4A, supply oil is connected to oil pressure bias recess 132*a* which creates a bias in the advance direction. When camshaft torque in the retard direction becomes greater than the advance bias, vane 160 will rotate in the counterclockwise direction, forcing oil from recess 131*b*. Accordingly, oil will flow to retard recess 132*b* via line 625, line 622, input line 182, and through check valve 182*a*, resulting in retard actuation. With camshaft torque in the advance direction, check valve 182*a* and spool valve land 200B block any flow out of recess 132*b*.

In FIG. 4B, supply oil is still connected to oil pressure bias recess 132*a*, creating a bias in the advance direction. Recess chambers 131*b* and 132*b* are also connected to supply oil pressure and are equally balanced with no camshaft torque in either direction the system will advance because of this bias. The flow path of oil is from recess 132*b* through line 624, line 621, cavity 198*c*, inlet line 182, and check valve 182*b*. Any camshaft torque in the advance direction will only add to the actuation rate. Consequently, the system will actuate with either the advance bias, camshaft torque in the advance direction, or both.

What is claimed is:

1. An internal combustion engine, comprising:

a crankshaft, said crankshaft being rotatable about a first axis;

a camshaft (126), said camshaft (126) being rotatable about a second axis, said second axis being parallel to said first axis, said camshaft (126) being subject to torque reversals during the rotation thereof;

a vane (160), said vane (160) having circumferentially spaced apart lobes (160*a*, 160*b*), said vane (160) being attached to said camshaft (126), said vane (160) being rotatable with said camshaft (126) and being non-oscillatable with respect to said camshaft (126);

a housing (129), said housing (129) being rotatable with said camshaft (126) and being oscillatable with respect to said camshaft (126), said housing (129) having first and second circumferentially spaced apart recesses (131, 132), each of said first and second recesses (131, 132) receiving one of said first and second lobes (160*a*, 160*b*) and permitting oscillating movement of said one of said first and second lobes (160*a*, 160*b*) therein, said first and second recesses (131, 132) being divided into first direction chambers (131*a*, 132*b*) and second direction chambers (131*b*, 132*a*) by said first and second lobes (160*a*, 160*b*), respectively, said first and second direction chambers (131*a*, 132*a*, 131*b*, 132*b*) of said first and second recesses (131, 132) each being capable of sustaining hydraulic pressure due to engine oil contained in said engine;

a spool valve (192) for selectively providing engine oil to said first direction chambers (131*a*, 132*b*) and said second direction chambers (131*b*, 132*a*);

a first check valve (408*a*) for providing unidirectional engine oil flow from said first direction chambers (131*a*, 132*b*) and a second check valve (407*a*) for providing unidirectional engine oil flow from said second direction chambers (131*b*, 132*a*);

means for transmitting rotary movement to said housing (129); and, means reactive to said engine oil pressure from an oil pump for varying the position of said housing (129) relative to said camshaft (126).

2. An engine according to claim 1 wherein said means reactive to engine oil pressure comprises control means for permitting said housing (129) to move in a first direction relative to said camshaft (126) in response to engine oil flow, and for preventing said housing (129) from moving in a second direction relative to said camshaft (126) in response to engine oil flow.

3. An engine according to claim 2 wherein said control means comprises means for transferring said engine oil into one of said first direction chambers (131*a*, 132*b*) and said second direction chambers (131*b*, 132*a*) of each of said first and second recesses (131, 132), said control means further comprising means for simultaneously transferring engine oil out of the other of said first direction chambers (131*a*, 132*b*) and said second direction chambers (131*b*, 132*a*) of each of said first and second recesses (131, 132).

4. An engine according to claim 3 wherein said control means is capable of being reversed to transfer engine oil out of said one of said first direction chambers (131*a*, 132*b*) and said second direction chambers (131*b*, 132*a*) of said each of said first and second recesses (131, 132) and to transfer engine oil into said other of said first direction chambers (131*a*, 132*b* ) and said second direction chambers (131*b*, 132*a*) of each of said first and second recesses (131, 132), said engine further comprising:

an engine control unit (108), said engine control unit (108) responsive to at least one engine operating condition for selectively reversing the operation of said control means.

5. An engine according to claim 4 wherein said engine further comprises:

at least one conduit means (130*a*) for transferring said engine oil from a portion of said engine to said control means; and, at least one conduit means (130*a*) for transferring said engine oil from said control means to said portion of said engine.

6. An engine according to claim 5 further comprising passage means connecting said one of said first direction chambers (131*a*, 132*b*) and said second direction chambers (131*b*, 132*a*) of one of said first recess (131) and said second recess (132) with the other of one of said first section chambers (131*a*, 132*b*) and said second direction chambers (131*b*, 132*a*) of the other of said first recess (131) and said second recess (132) to permit engine oil flow between one of said first direction chambers (131*a*, 132*b*) and said second direction chambers (131*b*, 132*a* ) of one of said first recess (131) and said second recess (132) and the other of one of said first direction chambers (131*a*, 132*b*) and said second direction chambers (131*b*, 132*a* ) of the other of said first recess (131) and said second recess (132).

7. An engine according to claim 1 wherein said spool valve comprises:

a spool (300), said spool (300) being reciprocatable within said spool valve body (198) and having a plurality of spaced apart lands (300*a*, 300*b*, 300*c*);

first conduit means (101) extending from one of said first recess (131) and said second recess (132) to said spool valve body (198), one of said plurality of lands (300*a*, 300*b*, 300*c*) selectively blocking and permitting flow through said first conduit means (101);

second conduit means (102) extending from the other of said first recess (131) and said second recess (132) to said spool valve body (198), another of said plurality of lands (300*a*, 300*b*, 300*c*) selectively blocking and permitting flow through said second conduit means (102).

8. An engine according to claim 7 wherein at least one of said plurality of lands (300*a*, 300*b*, 300*c*) of said spool (300) contains a passage (320) extending therethrough, said passage (320) providing communication for the flow of engine oil through said spool (300) to said recesses (131, 132) of said housing (129), said passage (320) having check valve means for preventing flow of engine oil from said recesses (131, 132) through said spool.

9. An engine according to claim 8 wherein said housing (129) is rotatable only to a first extreme angular position in said first direction relative to said camshaft (126) and a second extreme angular position in said second direction relative to said camshaft (126).

10. An engine according to claim 9 wherein torque pulses are present in said camshaft (126), said torque pulses being of such magnitude whereby causing said housing (129) to rotate relative to said camshaft (126).

11. An internal combustion engine, comprising:

a crankshaft, said crankshaft being rotatable about a first axis;

a camshaft (126), said camshaft (126) being rotatable about a second axis, said second axis being parallel to said first axis, said camshaft (126) being subject to torque reversals during the rotation thereof;

a vane (160), said vane (160) having circumferentially spaced apart lobes (160*a*, 160*b*), said vane (160) being attached to said camshaft (126), said vane (160) being rotatable with said camshaft (126) and being non-oscillatable with respect to said camshaft (126);

a housing (129), said housing (129) being rotatable with said camshaft (126) and being oscillatable with respect to said camshaft (126), said housing (129) having first and second circumferentially spaced apart recesses (131, 132), each of said first and second recesses (131, 132) receiving one of said first and second lobes (160*a*, 160*b*) and permitting oscillating movement of said one of said first and second lobes (160*a*, 160*b*) therein, said first and second recesses (131, 132) being divided into first direction chambers (131*a*, 132*b*) and second direction chambers (131*b*, 132*a*) by said first and second lobes (160*a*, 160*b*), respectively, said first and second direction chambers (131*a*, 132*a*, 131*b*, 132*b*) of said first and second recesses (131, 132) each being capable of sustaining hydraulic pressure due to engine oil contained in said engine;

means for transmitting rotary movement to said housing (129);

a first check valve (408*a*) for providing unidirectional engine oil flow from said first direction chambers (131*a*, 132*b*) and a second check valve (407*a*) for providing unidirectional engine oil flow from said second direction chambers (131*b*, 132*a*);

means reactive to said engine oil pressure from an oil pump for varying the position of said housing (129) relative to said camshaft (126), said reactive means comprising control means for permitting said housing (129) to move in a first direction relative to said camshaft (126) in response to engine oil flow, and for preventing said housing (129) from moving in a second direction relative to said camshaft (126) in response to engine oil flow, said control means comprising means for transferring said engine oil into one of said first direction chambers (131*a*, 132*b*) and said second direction chambers (131*b*, 132*a*) of each of said first and second recesses (131, 132), said control means further comprising means for simultaneously transferring engine oil out of the other of said first direction chambers (131*a*, 132*b*) and said second direction chambers (131*b*, 132*a*) of each of said first and second recesses (131, 132), wherein said control means is capable of being reversed to transfer engine oil out of said one of said first direction chambers (131*a*, 132*b*) and said second direction chambers (131*b*, 132*a*) of said each of said first and second recesses (131, 132) and to transfer engine oil into said other of said first direction chambers (131*b*, 132*a*) and said second direction chambers (131*b*, 132*a*) of each of said first and second recesses (131, 132), said control means still further comprising a spool valve body (198), a spool (300), said spool (300) being reciprocatable within said spool valve body (198) and having a plurality of spaced apart lands (300*a*, 300*b*, 300*c*), first conduit means (101) extending from one of said first recess (131) and said second recess (132) to said spool valve body (198), one of said plurality of lands (300*a*, 300*b*, 300*c*) selectively blocking and permitting flow through said first conduit means (101), second conduit means (102) extending from the other of said first recess (131) and said second recess (132) to said spool valve body (198), another of said plurality of lands (300*a*, 300*b*, 300*c*) selectively blocking and permitting flow through said second conduit means (102);

an engine control unit (108), said engine control unit (108) responsive to at least one engine operating condition for selectively reversing the operation of said control means; and, third conduit means (130*a*) for transferring said engine oil from a portion of said engine to said control means and for transferring said engine oil from said control means back to said portion of said engine.

12. An engine according to claim 11 wherein at least one of said plurality of lands (300*a*, 300*b*, 300*c*) of said spool (300) contains a passage (320) extending therethrough, said passage (320) providing communication for the flow of engine oil through said spool (300) to said recesses (131, 132) of said housing (129), said passage (320) having a check valve means for preventing flow of engine oil from said recesses (131, 132) through said spool.

13. An engine according to claim 12 wherein said housing (129) is rotatable only to a first extreme angular position in said first direction relative to said camshaft (126) and a second extreme angular position in said second direction relative to said camshaft (126).

14. An engine according to claim 13 wherein torque pulses are present in said camshaft (126), said torque pulses being of such magnitude wherein causing said housing (129) to rotate relative to said camshaft (126).

* * * * *